United States Patent [19]

Borenstein

[11] Patent Number: 5,050,655

[45] **Date of Patent: * Sep. 24, 1991**

[54] COMBINATION SNAP LOCK GOLF CLUB COVER AND CLEANING TOOL

[75] Inventor: Charles Borenstein, Miami, Fla.

[73] Assignee: BSF Industries, Inc., Miami, Fla.

[ * ] Notice: The portion of the term of this patent subsequent to Nov. 20, 2007 has been disclaimed.

[21] Appl. No.: 450,838

[22] Filed: Dec. 14, 1989

Related U.S. Application Data

[63] Continuation-in-part of Ser. No. 303,309, Jan. 27, 1989, Pat. No. 4,971,126.

[51] Int. Cl.[5] ..... A63B 57/00

[52] U.S. Cl. ..... 150/160; 15/105; 206/315.4

[58] Field of Search ..... 150/159, 160; 206/315.2, 315.3, 315.4; 15/105, 111; 273/32 B, 32 R

[56] References Cited

U.S. PATENT DOCUMENTS

| | | | |
|---|---|---|---|
| 2,128,546 | 8/1938 | Jenmore | 150/160 X |
| 2,857,608 | 10/1958 | Schwartz | 15/111 |
| 2,925,840 | 2/1960 | Hird | 206/315.4 |
| 2,981,964 | 5/1961 | Downing | 15/111 X |
| 3,047,896 | 8/1962 | Gunderson | 15/111 |
| 3,128,812 | 4/1964 | Scheurer | 206/315.4 |
| 3,406,419 | 10/1968 | Young | 15/104.94 |
| 3,478,799 | 11/1969 | Hoyt, Jr. | 150/160 |
| 3,593,769 | 7/1971 | Spears | 150/160 |
| 3,613,760 | 10/1971 | Koehnle | 150/160 |
| 3,638,284 | 2/1972 | Baker | 150/160 X |
| 3,664,399 | 5/1972 | Neff | 150/160 |
| 3,938,570 | 2/1976 | Stewart | 150/160 |
| 4,086,678 | 5/1978 | Torr | 15/105 |
| 4,164,969 | 8/1979 | Dien | 150/160 X |
| 4,195,677 | 4/1980 | Hagg et al. | 150/160 |
| 4,378,832 | 4/1983 | Thompson | 150/160 |
| 4,498,579 | 2/1985 | Brick | 206/315.4 |

FOREIGN PATENT DOCUMENTS

| | | | |
|---|---|---|---|
| 261329 | 5/1965 | Australia | 206/315.2 |
| 12382 | 1/1914 | United Kingdom | 206/315.2 |
| 974912 | 11/1964 | United Kingdom | 150/160 |

*Primary Examiner*—Sue A. Weaver

*Attorney, Agent, or Firm*—Malin, Haley, McHale, Dimaggio & Crosby

[57] ABSTRACT

A combination snap lock golf club cover and cleaning tool comprising a cover in two parts, pivotally connected, being of a semi-rigid, flexible material, and designed to generally facilitate and correspond to the dimensions of a golf club, a brush attached to the cover, and a scraper also attached to the cover. In the preferred embodiment, the brush and scraper are made of the same material as the cover and integrally attached thereto. A snap-lock mechanism is provided to securely lock the two parts of the cover together. The club number is displayed on the cover to identify the golf club enclosed within the cover.

23 Claims, 2 Drawing Sheets

FIG. 1
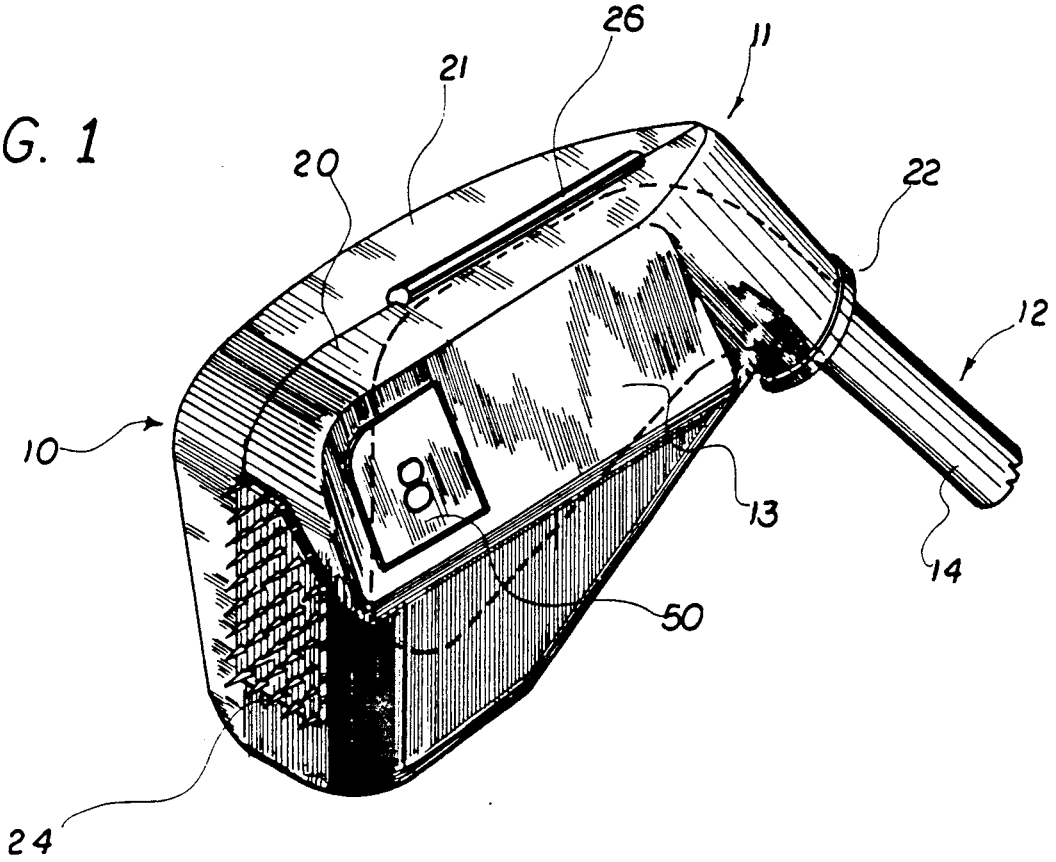
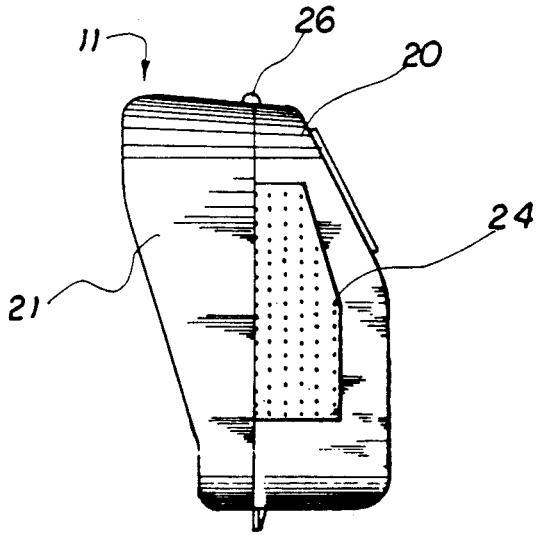
FIG. 2
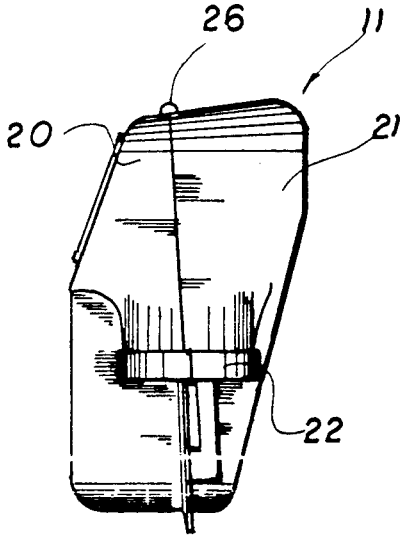
FIG. 3

FIG. 4
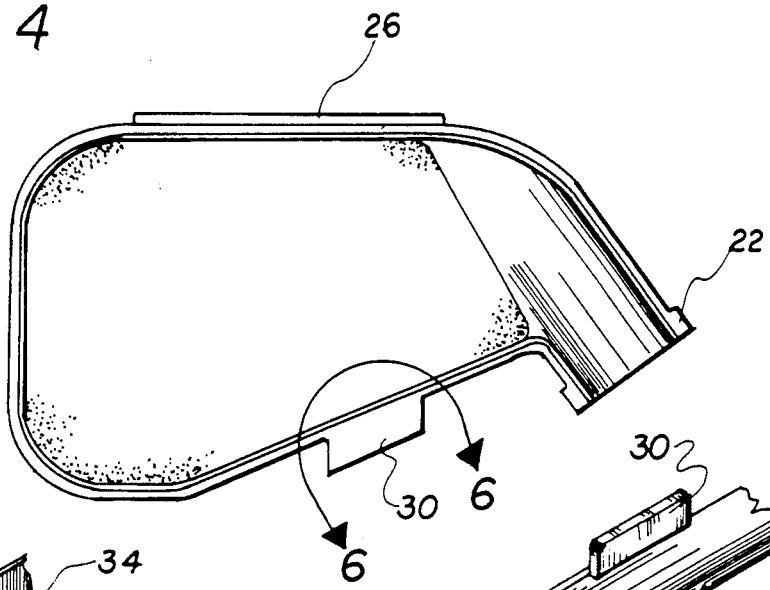
FIG. 5
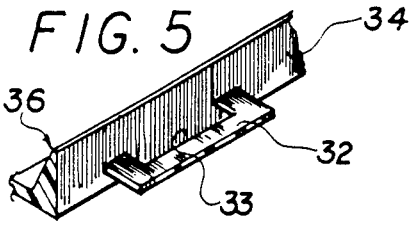
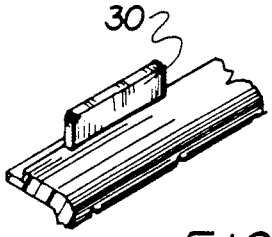
FIG. 6
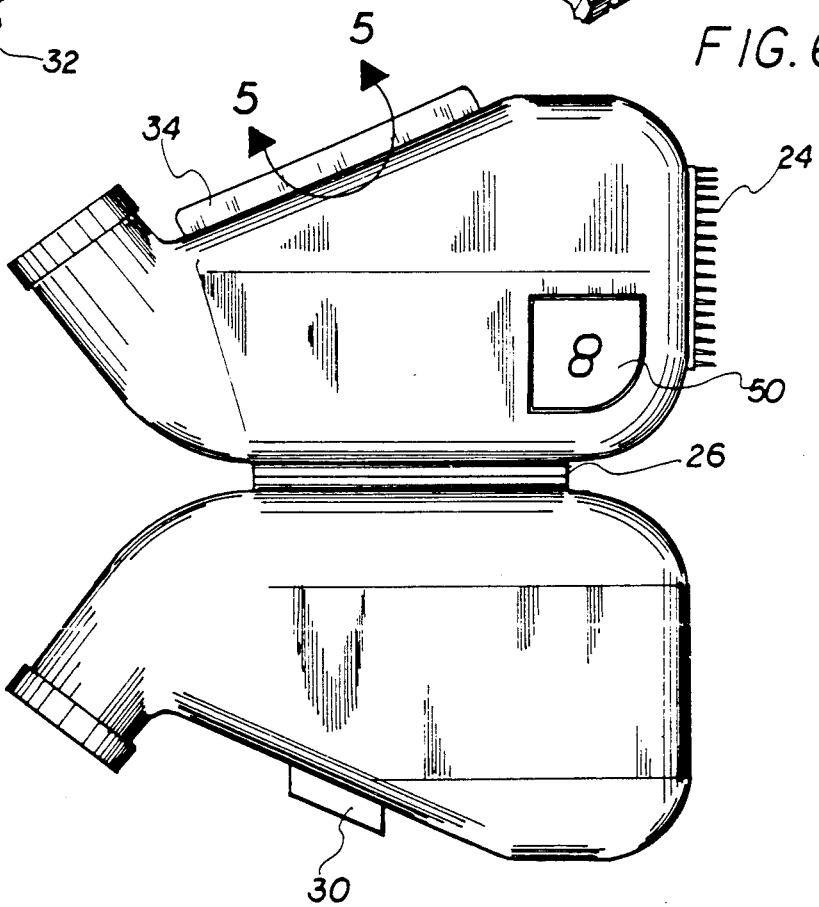
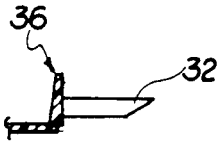
FIG. 8
FIG. 7

COMBINATION SNAP LOCK GOLF CLUB COVER AND CLEANING TOOL

This is continuation-in-part of application Ser. No. 07/303,309, filed Jan. 27, 1989, now U.S. Pat. No. 4,971,126.

BACKGROUND OF THE INVENTION

1. Field of the Invention

The subject matter of the invention relates to golf club covers and more particularly to a combination golf club cover which incorporates a brush and a scraper as integral parts of the cover.

2. Description of Related Art

Over the years golfers have developed a number of accessory products for use with golf clubs and golf bags. These include a variety of golf club covers, cleaning equipment, decorative items, and novelty items. For example, U.S. Pat. No. 3,478,799 discloses a basic golf club cover; U.S. Pat. No. 3,128,812 discloses a type of golf club cover which is readily detachable from a golf bag; U.S. Pat. No. 625,862 discloses a decorative golf club cover with tassels; U.S. Pat. No. 3,831,652 discloses a cover and towel means; and U.S. Pat. No. 3,406,419 discloses a self-polishing golf club cover.

Although many of the above referenced patents relate to some form of a golf club cover, none of these inventions teach or suggest a combination golf club cover which opens to allow easy placement of the golf club and then snaps securely closed around the golf club and a brush and scraper integrally incorporated into the golf club cover for easy use in cleaning the golf clubs, particularly while the golfer is on the fairways or playing the game. It is therefore highly desirable to provide such a combination golf club cover.

It is also highly desirable to provide a combination snap locked golf club cover, brush, and scraper which is cost effective yet operationally efficient.

It is also highly desirable to provide a combination snap locked golf club cover, brush, and scraper which can be adapted for use with any given golf club.

It is also highly desirable to provide a combination snap locked golf club cover, brush, and scraper which readily interfaces with the golf club itself, and eliminates the need for carrying an individual golf club brush as well as an individual golf club scraper as extraneous accessories within the golf bag.

It is finally highly desirable to provide a combination snap locked golf club cover, brush, and scraper which incorporates all of the above mentioned features and objects.

SUMMARY OF THE INVENTION

What is provided is a combination snap locked golf club cover, brush and scraper. The snap locked golf club cover is comprised of a cover in two halves, corresponding in shape to a golf club head, hinged along the part of the cover corresponding to the sole of the club head so as to allow the two halves to be separated exposing the interior of the cover and allowing easy placement of a golf club head therein. Along the edge of both halves of the cover corresponding to the hosel of the club head is a snap lock mechanism that locks the two halves securely together around the golf club head when both halves are pressed together by hand.

The brush, in one embodiment, is comprised of hard bristles protruding outward from the golf club cover which are capable of easily and efficiently cleaning a golf club while the game is in play by vigorous, physical contact between the bristles and the material to be removed. The scraper is comprised of an elongated rigid material coming to a knife-like edge and attached to the golf club cover at a point corresponding to the hosel of the club head. Interaction of the bristles with the parallel grooves of the club head is particularly effective in removing any debris that may have accumulated there.

Golfers, both accomplished and hackers, frequently soil the golf club face or head with dirt, mud, sand, grass, weeds or other impediments frequently found on the typical golf course. It then becomes necessary to clean the club face or head, which is accomplished by using the instant brush and scraper to render the golf club most effective. On a particular shot, it is possible for the club face to accumulate a substantial amount of dirt or mud by impact between the club face and dirt or mud, which is easily removed with the instant scraper of the invention. After the extraneous matter is removed from the club face, the brush can thereafter be used to further clean the club face and particularly the parallel grooves of the club face so that it is ready for the next shot.

It is therefore an object of the invention to provide a combination snap locked golf club cover which integrally includes a brush and scraper.

It is also an object of the invention to provide a combination snap locked golf club cover, brush, and scraper which is cost effective yet operationally efficient.

It is also an object of the invention to provide a combination snap locked golf club cover, brush, and scraper which can be adapted for use with any given golf club.

It is also an object of the invention to provide a combination snap locked golf club cover, brush, and scraper which readily interfaces with the golf club itself, and eliminates the need for carrying an individual golf club brush as well as an individual golf club scraper as extraneous accessories within the golf bag.

It is finally an object of the invention to provide a combination snap locked golf club cover, brush, and scraper which incorporates all of the above mentioned features and objects.

BRIEF DESCRIPTION OF THE DRAWINGS

The above mentioned and other features and objects of this invention and the manner of attaining them will become more apparent and the invention itself will be best understood by reference to the following description of an embodiment of the invention taken in conjunction with the accompanying drawings, wherein:

FIG. 1 is a perspective view of an embodiment of the invention enclosing a golf club shown in phantom;

FIG. 2 is an end plan view of the instant invention;

FIG. 3 is an end plan view of the invention opposite of the view in FIG. 2 showing the neck enclosing the shaft of the golf club whose club head is enclosed in the invention;

FIG. 4 is a front plan view of the invention showing the stem part of the locking mechanism;

FIG. 5 is a close-up view of the ring part of the locking mechanism;

FIG. 6 is a close-up view of the stem part of the locking mechanism shown in FIG. 4;

FIG. 7 is a top view of the invention opened along the hinge connecting the two halves of the cover;

FIG. 8 is a side view of the ring showing the angled end where the stem meets the ring.

DESCRIPTION OF THE PREFERRED EMBODIMENT

Referring now to FIG. 1, the combination snap lock golf club cover and cleaning tool is generally shown at 10. A typical golf club 12 is shown in phantom in functional position with the club head 13 enclosed within the device and the club shaft 14 extending out of the device through the neck 22. Brush 24 comprised of rigid bristles extending away from the first cover half 20 is shown integrally connected to the first cover half 20. Also shown is a hinge 26 pivotally connecting the first cover half 20 and a second cover half 21 to form a cover 11 when the first and second cover halves 20, 21 are closed. An identification space 50 showing the number of the club enclosed within the club cover halves 20, 21 is included to aid in selecting the appropriate club at the proper time during play.

Golf club cover halves 20, 21 are designed and formed to generally facilitate and accommodate the shape of the golf club head 13. As shown in FIGS. 2 and 3, the golf club cover 11 can have a pitch which generally corresponds to the pitch of a typical golf club head, for example irons 2 through 9, the sand wedge and the pitching wedge. The cover 11 can also be formed to enclose the wood clubs. For purposes of the instant invention, the shape of the golf club cover 11 is not critical, as long as it corresponds generally to the shape of the particular club desired.

In a particular embodiment, the golf club cover halves 20, 21 are made of a semi-rigid, flexible material such as plastic, which can be easily placed over the golf club head 13 to protect the club head 13. The shape of the cover 11 corresponds to the shape of the club head 13 to provide a "tight" fit, such that the covers 11 is not accidentally removed, or lost, during play. Referring to FIG. 3, neck 22, is dimensioned to snuggly fit around the golf club shaft 14 to aid in preventing accidental removal.

As shown in FIGS. 4–7, the two cover halves 20, 21 are locked in a closed position by the interconnection of a stem 30 integrally attached to the second cover half 21 and a ring 32 integrally attached to a scraper 34 which is in turn integrally attached to the first cover half 20. The stem 30 and the ring 32 are both made of the same semi-rigid, flexible material that the cover halves 20, 21 are made of. The ring 32 has an internal slot 33 corresponding in shape to stem 30. As shown in FIG. 8, the edge of the ring 32 farthest from the scraper 34 is angled to aid in engaging the stem 30.

To engage the locking capabilites of the stem 30 and the ring 32, the two cover halves 20, 21 are brought close together so that the stem 30 and the ring 32 come in contact with each other. Slight pressure on the sides of the cover halves 20, 21 causes the ring 32 to bend slightly upward at the angled part of ring 32 and move over the stem 30. Continued pressure on the sides of the cover halves 20, 21 causes the ring 32 to continue over the stem 30 until the stem 30 meets the slot 33. At this time the stem 30 moves into the slot 33 which encloses stem 30 and locks the two halves 20, 21 securely together.

From FIGS. 1, 2 and 7 it can be seen that the scraper 34 and brush 24 are integrally formed with and of the same material as the golf club cover. As seen in FIG. 5, scraper 34 comes to a sharpened edge at 36. Thus, scraper 34 provides a sharp, yet rigid, knife-like edge which can be utilized to scrape, or clean, excessive dirt or mud from the face of the golf club. In this embodiment, scraper 34 is conveniently located at the underside of the cover halves 20, 21 so that the closed and locked cover halves 20, 21 provide a handle for the scraper 34 that rests in the palm of the user's hand and is easily manipulated to clean the club head 13.

The brush 24 is comprised of a plurality of rigid, spike-like bristles extending perpendicular to the end of the first cover half 20. In this embodiment, the brush 24 is positioned at the end of the first cover half 20 so that the user can easily grasp the snap locked cover halves 20, 21 in the palm between the thumb and fingers. In this way, the user can vigorously apply the bristles to any debris to be cleaned. The brush 24 can either be used by itself to clean debris, or after use of the scraper 34 to further clean debris better suited to be removed by the bristles of the brush 24.

The instant invention accomplishes many functions for the golfer. The golf club cover 11 itself operates in a conventional manner to protect the club face, and is easily placed on and removed from the golf club 12 during play. The brush 24 and scraper 34 provide the mechanism for efficiently and effectively cleaning the golf club on the golf course, and eliminates the necessity for a separate golf club brush and scraper to be purchased and carried within a golf bag.

All irons today have a plurality of parallel grooves running across the face of the iron which increases the contact and propulsion of the golf ball. With a proper golf swing, the iron will contact a portion of the golf course turf slightly behind the ball, and the club will create a divot in the turf. The sod or mud then becomes caked within the grooves of the iron, and this requires cleaning before the next shot. This is easily and readily accomplished by the application of the scraper and brush of the instant invention. It also greatly eliminates the accidental loss of such accessory equipment.

It will be recognized by those of ordinary skill in the art, that in an alternative embodiment the brush 24 could be any of a variety of brush-like members, which includes rigid bristles, rubber bristles, synthetic or plastic bristles, etc. and attached to the first cover half 20 or second cover half 21 or both by any conventional means. In addition, the scraper 34 could be made of any of a number of rigid materials capable of having a sharpened edge at 36 such as metal, wood, or bone and attached to the first cover half 20 or second cover half 21 by any conventional means.

While there have been described above the principles of this invention in conjunction with specific apparatus, it is to be clearly understood that this description is made only by way of example and not as a limitation to the scope of the invention.

What is claimed is:

1. A combination snap lock golf club cover and cleaning tool comprising:

cover means having a first cover half and a second cover half, and designed to correspond to the shape of and enclose a golf club head;

means to pivotally connect said first and second cover halves;

means to lock said first cover half to said second cover half, and means attached to said cover means to clean a golf club head.

2. A combination snap lock golf club cover and cleaning tool as claimed in claim 1 wherein said first and second cover halves are made of a semi-rigid, flexible material.

3. A combination snap lock golf club cover and cleaning tool as claimed in claim 1 wherein said means to pivotally connect said first and second cover halves is a hinge.

4. A combination snap lock golf club cover and cleaning tool as claimed in claim 3 wherein said hinge is located along the edges of said first and second cover halves that corresponds to the sole of a golf club head.

5. A combination snap lock golf club cover and cleaning tool as claimed in claim 3 wherein said hinge is integrally formed from said first and second cover halves.

6. A combination snap lock golf club cover and cleaning tool as claimed in claim 1 wherein said cover means further comprises a neck designed to receive the shaft of the golf club head enclosed within said cover means.

7. A combination snap lock golf club cover and cleaning tool as claimed in claim 6 wherein said neck is formed in part on said first cover half and in part on said second cover half.

8. A combination snap lock golf club cover and cleaning tool as claimed in claim 1 wherein said means to lock said first cover half to said second cover half comprises:

a stem attached to one of said cover halves, and protruding therefrom;

a ring attached to the other of said cover halves; having a slot adaptable to receive and enclose said stem.

9. A combination snap lock golf club cover and cleaning tool as claimed in claim 8 wherein said stem protrudes from one of said cover halves in a direction normal to the outer surface of said one of said cover halves and said ring protrudes from said other of said cover halves in a direction parallel to the outer surface of said other of said cover halves.

10. A combination snap lock golf club cover and cleaning tool as claimed in claim 8 wherein said stem protrudes from one of said cover halves in a direction parallel to the outer surface of said one of said cover halves, and said ring protrudes from said other of said cover halves in a direction perpendicular to the outer surface of said other of said cover halves.

11. A combination snap lock golf club cover and cleaning tool as claimed in claim 9 wherein the edge of said ring farthest from the connection point of said ring to said other of said cover halves is tapered so as to dispose said ring over said stem when said ring and said stem are brought into contact.

12. A combination snap lock golf club cover and cleaning tool as claimed in claim 1 wherein said means to clean a golf club head comprises brush means, attached to said cover means, having a plurality of bristle-like protrusions.

13. A combination snap lock golf club cover and cleaning tool as claimed in claim 12 wherein said bristle-like protrusions are made of a semi-rigid, flexible material.

14. A combination snap lock golf club cover and cleaning tool as claimed in claim 13 wherein said bristle-like protrusions are made of the same material as said cover means.

15. A combination snap lock golf club cover and cleaning tool as claimed in claim 14 wherein said bristle-like protrusions are integrally attached to said cover means.

16. A combination snap lock golf club cover and cleaning tool as claimed in claim 1 wherein said means to clean a golf club head comprises a scraper, attached to said cover means, having a knife-like edge.

17. A combination snap lock golf club cover and cleaning tool as claimed in claim 16 wherein said scraper is elongated in shape.

18. A combination snap lock golf club cover and cleaning tool as claimed in claim 16 wherein said scraper is made of a semi-rigid, flexible material.

19. A combination snap lock golf club cover and cleaning tool as claimed in claim 18 wherein said scraper is made of the same material as said cover means.

20. A combination snap lock golf club cover and cleaning tool as claimed in claim 19 wherein said scraper is integrally attached to said cover means.

21. A combination snap lock golf club cover and cleaning tool as claimed in claim 1 wherein said means to lock said first cover half to said second cover half comprises:

a stem attached to one of said cover halves, and protruding therefrom in a direction normal to the outer surface of said one of said cover halves;

a ring disposed to come into contact with said stem, said ring disposed in perpendicular relation to said stem when said ring is in contact with said stem, said ring having a slot adaptable to receive and enclose said stem; and, means for attaching said ring to the other of said cover halves so that said ring will be disposed in perpendicular relation to said stem when said ring is in contact with said stem.

22. A combination snap lock golf club cover and cleaning tool as claimed in claim 1 further comprising means to identify the golf club enclosed within said cover means.

23. A combination snap lock golf club cover and cleaning tool as claimed in claim 1 further comprising means to cushion said golf club head within said cover means.

* * * * *